US011965508B2

(12) United States Patent
Maeda et al.

(10) Patent No.: US 11,965,508 B2
(45) Date of Patent: Apr. 23, 2024

(54) SCROLL COMPRESSOR

(71) Applicant: KABUSHIKI KAISHA TOYOTA JIDOSHOKKI, Aichi-ken (JP)

(72) Inventors: Takumi Maeda, Kariya (JP); Yuya Hattori, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 0 days.

(21) Appl. No.: 18/121,882

(22) Filed: Mar. 15, 2023

(65) Prior Publication Data

US 2023/0304493 A1 Sep. 28, 2023

(30) Foreign Application Priority Data

Mar. 28, 2022 (JP) ..... 2022-051147

(51) Int. Cl.

| | |
|---|---|
| ***F04C 29/02*** | (2006.01) |
| ***F04C 2/02*** | (2006.01) |
| ***F04C 15/00*** | (2006.01) |
| ***F04C 18/02*** | (2006.01) |
| ***F04C 27/00*** | (2006.01) |

(52) U.S. Cl.

CPC ..... *F04C 2/025* (2013.01); *F04C 15/0088* (2013.01); *F04C 2240/30* (2013.01)

(58) Field of Classification Search

CPC ..... F04C 15/008; F04C 29/02; F04C 29/028; F04C 29/026; F04C 18/0215; F04C 27/008

See application file for complete search history.

(56) References Cited

U.S. PATENT DOCUMENTS

| | | | | |
|---|---|---|---|---|
| 2018/0172004 | A1* | 6/2018 | Lee | F04C 23/008 |
| 2019/0101119 | A1* | 4/2019 | Hattori | F04C 29/026 |
| 2021/0062808 | A1* | 3/2021 | Hattori | F04C 23/008 |

FOREIGN PATENT DOCUMENTS

| | | | | |
|---|---|---|---|---|
| DE | 102018107460 | A1 * | 10/2018 | F04C 18/0215 |
| JP | 2000-018180 | A | 1/2000 | |
| JP | 2020-033989 | A | 3/2020 | |
| JP | 2020-165362 | A | 10/2020 | |

OTHER PUBLICATIONS

English translation of DE 1020181017460 by PE2E, Jun. 28, 2023.*

* cited by examiner

*Primary Examiner* — Deming Wan

(74) *Attorney, Agent, or Firm* — Greenblum & Bernstein, P.L.C.

(57) ABSTRACT

A scroll compressor includes a housing, a rotary shaft rotatably supported by the housing, a fixed scroll accommodated in the housing and fixed to the housing, an orbiting scroll that orbits as the rotary shaft rotates, a compression chamber defined between the fixed scroll and the orbiting scroll, a discharge chamber, and an oil passage. A refrigerant taken in from the outside is compressed in the compression chamber. The refrigerant compressed in the compression chamber is discharged into the discharge chamber. An outer peripheral space connected to the compression chamber is defined between the outer peripheral surface of the fixed scroll and the inner peripheral surface of the housing. Oil separated from the refrigerant discharged into the discharge chamber is guided to the outer peripheral space through the oil passage.

3 Claims, 5 Drawing Sheets

SCROLL COMPRESSOR

BACKGROUND

1. Field

The present disclosure relates to a scroll compressor.

2. Description of Related Art

In general, a scroll compressor includes a tubular housing. The scroll compressor includes a rotary shaft, a fixed scroll, an orbiting scroll, compression chambers, and a discharge chamber. The rotary shaft is rotatably supported by the housing. The fixed scroll is accommodated in the housing. The fixed scroll is fixed to the housing. The orbiting scroll orbits as the rotary shaft rotates. The compression chambers are defined between the fixed scroll and the orbiting scroll. Refrigerant drawn in from the outside is compressed in the compression chambers. The refrigerant compressed in the compression chambers is discharged into the discharge chamber.

Such a scroll compressor includes an oil passage for returning oil separated from the refrigerant discharged into the discharge chamber to the compression chambers. For example, Japanese Laid-Open Patent Publication No. 2020-165362 discloses an oil passage extending through a fixed scroll. The oil separated from the refrigerant is then returned to the outermost peripheral portion of the compression chambers in a decompressed state via the oil passage. The oil returned to the compression chambers contributes to lubrication between the fixed scroll and the orbiting scroll.

In a case in which an oil passage extends through a fixed scroll, the layout of the oil passage is limited due to the need for disposing the oil passage in a thick portion of the fixed scroll. Therefore, depending on the position of the oil passage, it may be difficult to smoothly return the oil to the compression chambers. This results in poor lubrication between the fixed scroll and the orbiting scroll, thus reducing the reliability of the scroll compressor.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a scroll compressor includes a housing, a rotary shaft rotatably supported by the housing, a fixed scroll accommodated in the housing and fixed to the housing, an orbiting scroll that orbits as the rotary shaft rotates, a compression chamber defined between the fixed scroll and the orbiting scroll, a discharge chamber, and an oil passage. A refrigerant drawn in from an outside is compressed in the compression chamber. The refrigerant compressed in the compression chamber is discharged into the discharge chamber. An outer peripheral space connected to the compression chamber is defined between an outer peripheral surface of the fixed scroll and an inner peripheral surface of the housing. Oil separated from the refrigerant discharged into the discharge chamber is guided to the outer peripheral space through the oil passage.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, except for operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

Hereinafter, a scroll compressor 10 according to an embodiment will be described with reference to FIGS. 1 to 4. The scroll compressor 10 according to the present embodiment is used in, for example, a vehicle air conditioner.

<Basic Configuration of Scroll Compressor 10>

Figure 1:
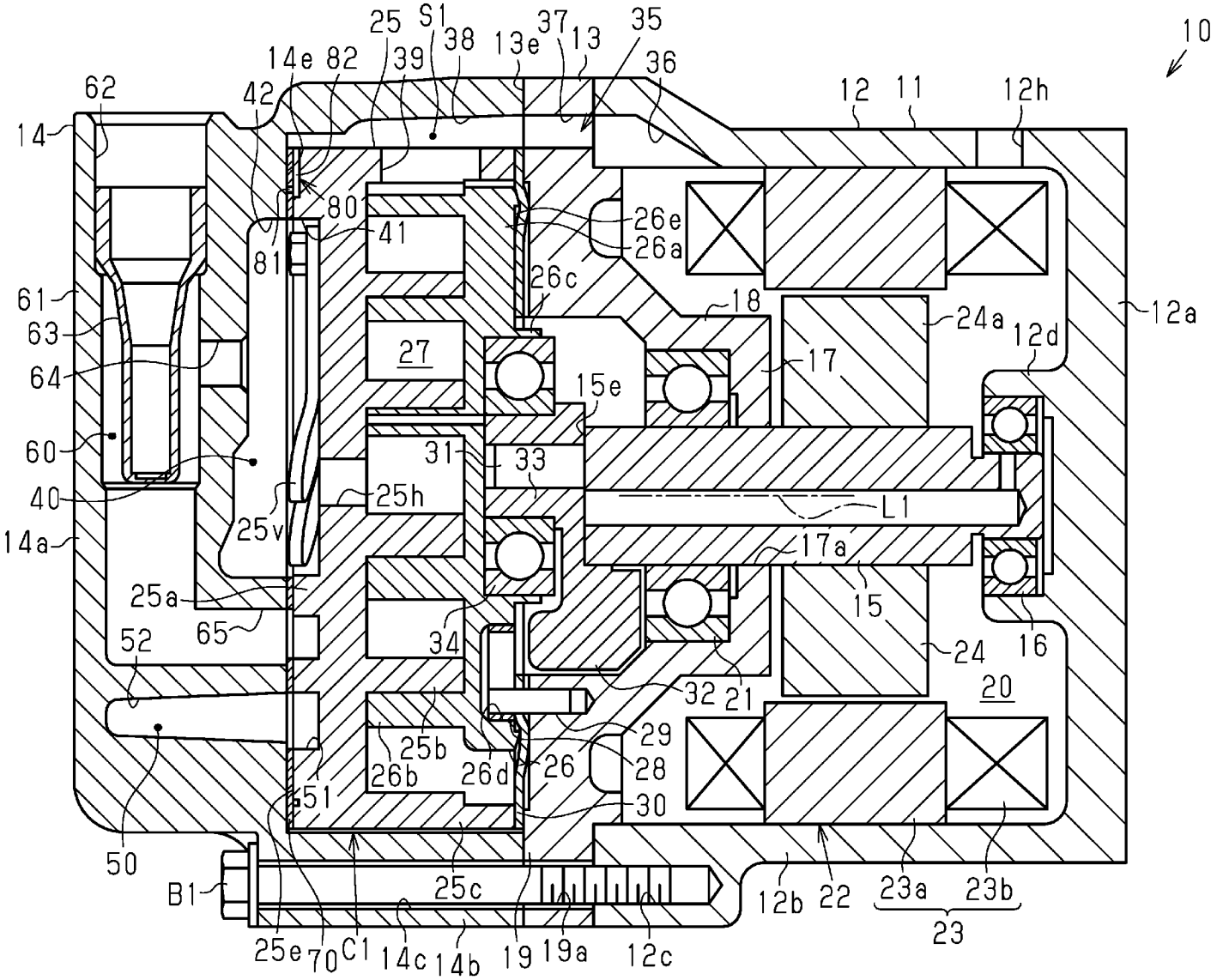
FIG. 1 is a cross-sectional view of a scroll compressor according to an embodiment.

As illustrated in FIG. 1, the scroll compressor 10 includes a cylindrical housing 11. The housing 11 includes a motor housing member 12, a shaft support housing member 13, and a discharge housing member 14. The motor housing member 12, the shaft support housing member 13, and the discharge housing member 14 are made of metal. The motor housing member 12, the shaft support housing member 13, and the discharge housing member 14 are made of, for example, aluminum. The scroll compressor 10 includes a rotary shaft 15. The rotary shaft 15 is accommodated in the housing 11.

The motor housing member 12 includes a plate-shaped end wall 12*a* and a cylindrical peripheral wall 12*b*. The peripheral wall 12*b* extends in a tubular shape from the outer periphery of the end wall 12*a*. The axial direction of the peripheral wall 12*b* agrees with the axial direction of the rotary shaft 15. The motor housing member 12 includes internal thread holes 12*c*. Each internal thread hole 12*c* opens at the opening end of the peripheral wall 12*b*. In FIG.

1, only one internal thread hole 12*c* is shown for illustrative purposes. The motor housing member 12 includes an inlet 12*h*. The refrigerant is drawn through the inlet 12*h*. The inlet 12*h* opens in a portion of the peripheral wall 12*b* near the end wall 12*a*. The inlet 12*h* connects the inside and the outside of the motor housing member 12 to each other.

The motor housing member 12 includes a cylindrical boss portion 12*d*. The boss portion 12*d* protrudes from the center of the inner surface of the end wall 12*a*. A first end in the axial direction of the rotary shaft 15 is inserted in the boss portion 12*d*. The scroll compressor 10 includes a bearing 16. The bearing 16 is, for example, a rolling-element bearing. The bearing 16 is disposed between the inner peripheral surface of the boss portion 12*d* and the outer peripheral surface of the first end portion of the rotary shaft 15. The first end of the rotary shaft 15 is rotatably supported by the motor housing member 12 with the bearing 16.

The shaft support housing member 13 includes a plate-shaped end wall 17 and a cylindrical peripheral wall 18. The peripheral wall 18 extends in a tubular shape from the outer periphery of the end wall 17. The axial direction of the peripheral wall 18 agrees with the axial direction of the rotary shaft 15. The shaft support housing member 13 includes an annular flange wall 19. The flange wall 19 extends outward in the radial direction of the rotary shaft 15 from the end of the outer peripheral surface of the peripheral wall 18 opposite to the end wall 17.

The shaft support housing member 13 includes a circular insertion hole 17*a*. The insertion hole 17*a* opens at the center of the end wall 17. The insertion hole 17*a* extends through the end wall 17 in the thickness direction. The rotary shaft 15 is inserted in the insertion hole 17*a*. A second end in the axial direction of the rotary shaft 15 includes an end face 15*e*. The end face 15*e* is located inside the peripheral wall 18.

The scroll compressor 10 includes a bearing 21. The bearing 21 is, for example, a rolling-element bearing. The bearing 21 is disposed between the inner peripheral surface of the peripheral wall 18 and the outer peripheral surface of the rotary shaft 15. The rotary shaft 15 is rotatably supported by the shaft support housing member 13 with the bearing 21. Hence the shaft support housing member 13 rotatably supports the rotary shaft 15. In this manner, the rotary shaft 15 is rotatably supported by the housing 11.

The shaft support housing member 13 includes bolt insertion holes 19*a*. Each bolt insertion hole 19*a* opens at the outer periphery of the flange wall 19. Each bolt insertion hole 19*a* extends through the flange wall 19 in the thickness direction. The bolt insertion holes 19*a* in the flange wall 19 are connected to the internal thread holes 12*c* in the motor housing member 12, respectively. In FIG. 1, only one bolt insertion hole 19*a* is shown for illustrative purposes.

The scroll compressor 10 includes a motor chamber 20. The motor chamber 20 is defined by a motor housing member 12 and a shaft support housing member 13. The motor housing member 12 defines the motor chamber 20 together with the shaft support housing member 13. In this manner, the motor chamber 20 is defined in the housing 11. The motor chamber 20 is connected to with the inlet 12*h*. The refrigerant drawn through the inlet 12*h* is drawn into the motor chamber 20. Therefore, the motor chamber 20 is a suction pressure zone.

The scroll compressor 10 includes a motor 22. The motor 22 is accommodated in the motor chamber 20. The motor 22 includes a cylindrical stator 23 and a cylindrical rotor 24. The rotor 24 is disposed inside the stator 23. The rotor 24 rotates integrally with the rotary shaft 15. The stator 23 surrounds the rotor 24. The rotor 24 includes a rotor core 24*a* fixed to the rotary shaft 15 and permanent magnets (not illustrated) provided on the rotor core 24*a*.

The stator 23 includes a cylindrical stator core 23*a* and a motor coil 23*b*. The stator core 23*a* is fixed to the inner peripheral surface of the peripheral wall 12*b* of the motor housing member 12. The motor coil 23*b* is wound around the stator core 23*a*. Electric power controlled by an inverter (not illustrated) is supplied to the motor coil 23*b*, whereby the rotor 24 rotates. As a result, the rotary shaft 15 rotates integrally with the rotor 24. Thus, the motor 22 rotates the rotary shaft 15.

The scroll compressor 10 includes a compression mechanism Cl. The compression mechanism Cl includes a fixed scroll 25 and an orbiting scroll 26. Accordingly, the scroll compressor 10 includes the fixed scroll 25 and the orbiting scroll 26. The compression mechanism Cl is of a scroll type. The orbiting scroll 26 orbits with respect to the fixed scroll 25 as the rotary shaft 15 rotates.

Figure 2:
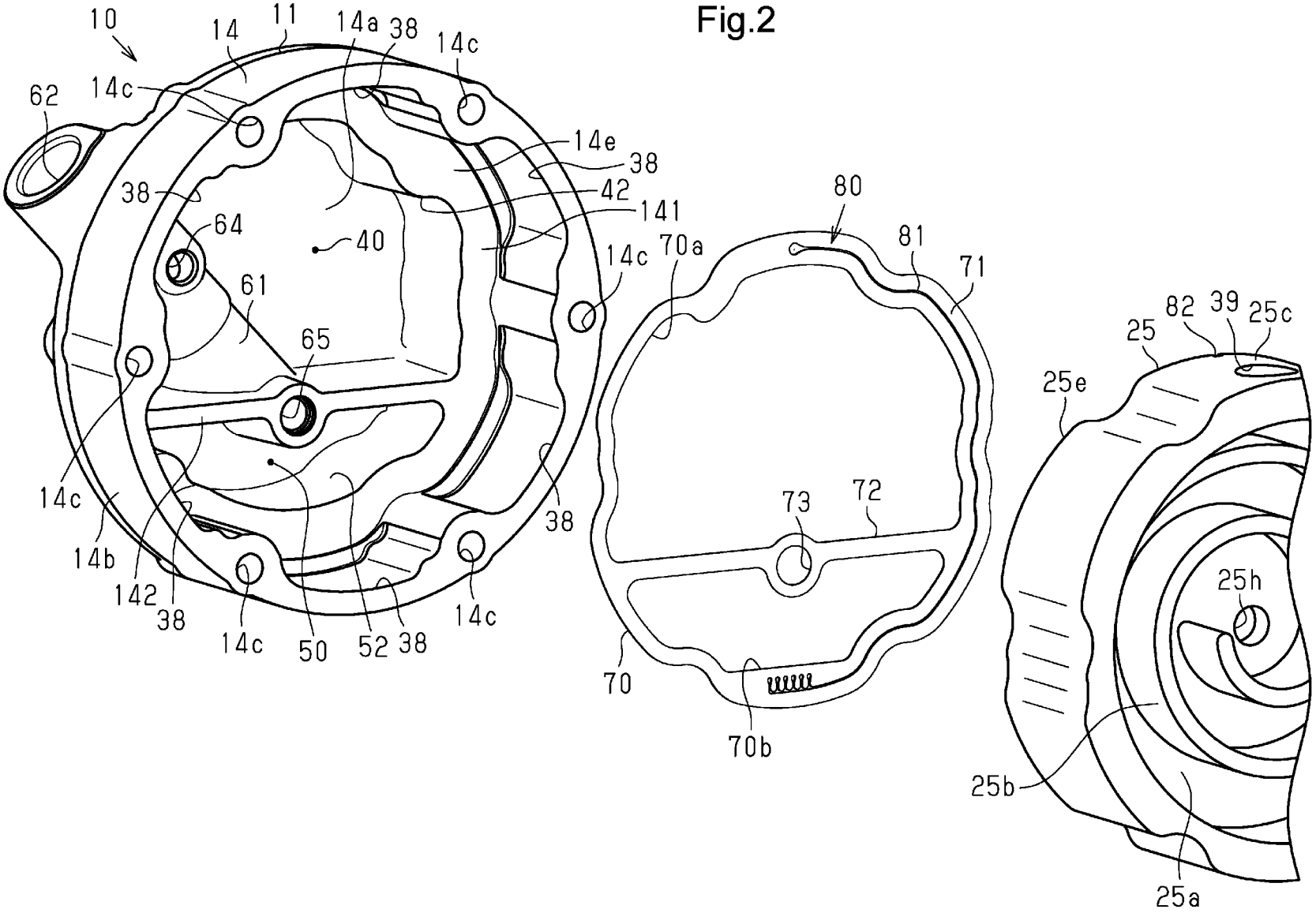
FIG. 2 is an exploded perspective view illustrating a part of the scroll compressor in FIG. 1.

As illustrated in FIGS. 1 and 2, the fixed scroll 25 includes a fixed base plate 25*a* and a fixed volute wall 25*b*. The fixed base plate 25*a* is a disc. A discharge port 25*h* opens at the center of the fixed base plate 25*a*. The discharge port 25*h* is a circular hole. The discharge port 25*h* extends through the fixed base plate 25*a* in the thickness direction. The fixed volute wall 25*b* extends from the fixed base plate 25*a*. The fixed scroll 25 includes an outer peripheral wall 25*c*. The outer peripheral wall 25*c* extends from the outer periphery of the fixed base plate 25*a*. The outer peripheral wall 25*c* surrounds the fixed volute wall 25*b*.

Figure 3:
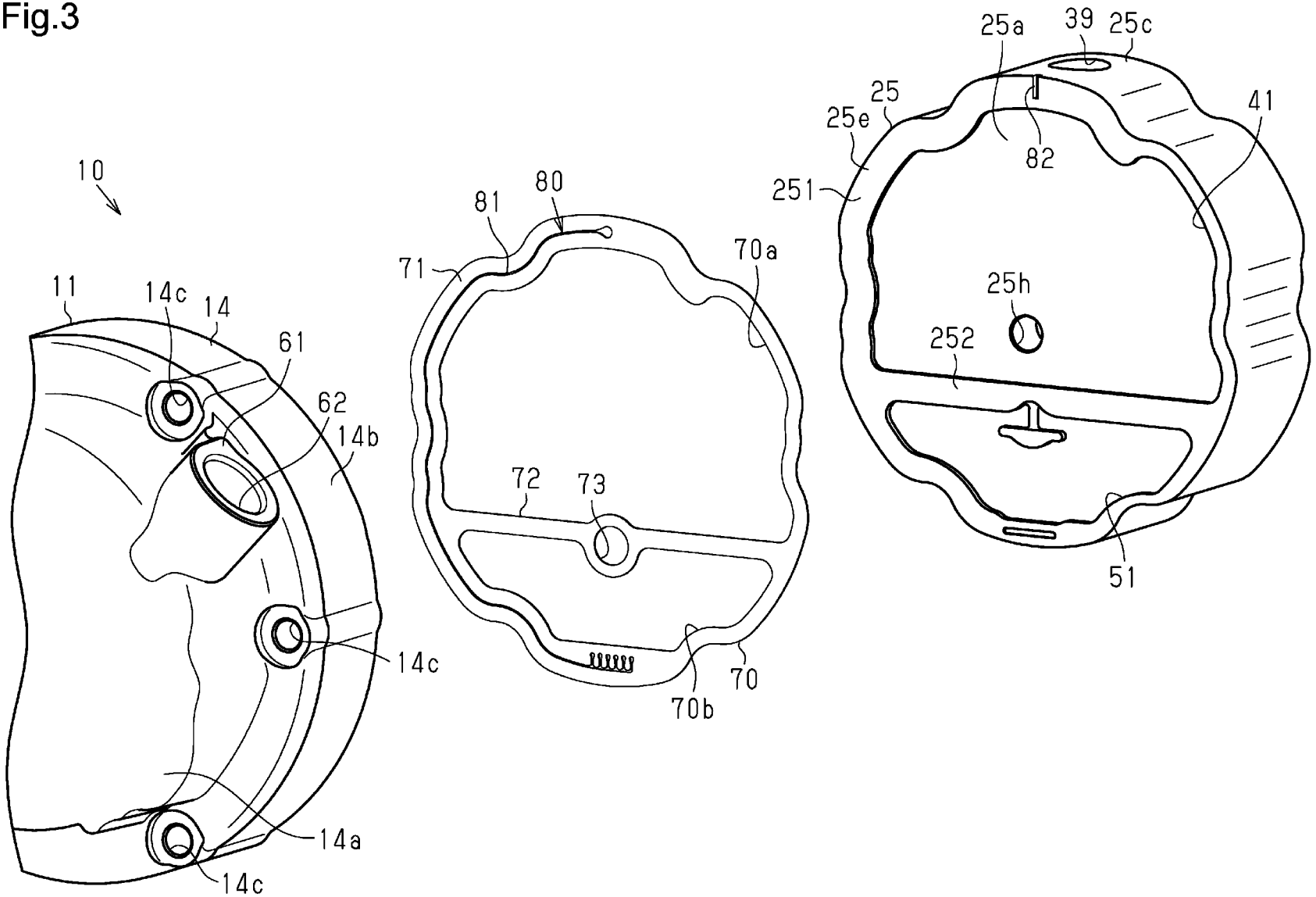
FIG. 3 is an exploded perspective view illustrating a part of the scroll compressor.

As illustrated in FIGS. 1 and 3, the fixed scroll 25 includes a first discharge chamber forming recess 41 and a first oil reservoir chamber forming recess 51. The first discharge chamber forming recess 41 and the first oil reservoir chamber forming recess 51 open in an end face 25*e* of the fixed base plate 25*a*. The end face 25*e* of the fixed base plate 25*a* includes a first annular end face 251 and a first connection end face 252. The first annular end face 251 includes an annular shape extending along the outer periphery of the fixed base plate 25*a*. The first connection end face 252 has a shape of an elongated strip. The first connection end face 252 is connected to the first annular end face 251 and extends between the first discharge chamber forming recess 41 and the first oil reservoir chamber forming recess 51.

The discharge port 25*h* opens in the bottom surface of the first discharge chamber forming recess 41. As illustrated in FIG. 1, the scroll compressor 10 includes a valve mechanism 25*v*. The valve mechanism 25*v* is attached to the bottom surface of the first discharge chamber forming recess 41. The valve mechanism 25*v* is configured to open and close the discharge port 25*h*.

The orbiting scroll 26 includes an orbiting base plate 26*a* and an orbiting volute wall 26*b*. The orbiting base plate 26*a* is a disc. The orbiting base plate 26*a* faces the fixed base plate 25*a*. The orbiting volute wall 26*b* extends from the orbiting base plate 26*a* toward the fixed base plate 25*a*. The orbiting volute wall 26*b* meshes with the fixed volute wall 25*b*. The orbiting scroll 26 is located inside the outer peripheral wall 25*c*. The orbiting scroll 26 orbits inside the outer peripheral wall 25*c*. The distal end face of the fixed volute wall 25*b* is in contact with the orbiting base plate 26*a*. The distal end face of the orbiting volute wall 26*b* is in contact with the fixed base plate 25*a*.

The scroll compressor 10 includes compression chambers 27. The compression chambers 27 are defined by the fixed base plate 25*a*, the fixed volute wall 25*b*, the orbiting base plate 26*a*, and the orbiting volute wall 26*b*. Accordingly, the compression chambers 27 are defined between the fixed scroll 25 and the orbiting scroll 26. The refrigerant drawn in from the outside is compressed in the compression chambers 27.

The orbiting base plate 26*a* includes a cylindrical boss portion 26*c*. The boss portion 26*c* protrudes from an end face 26*e* of the orbiting base plate 26*a* opposite to the fixed base plate 25*a*. The axial direction of the boss portion 26*c* agrees with the axial direction of the rotary shaft 15. The orbiting base plate 26*a* includes groove portions 26*d*. The groove portions 26*d* are arranged around the boss portion 26*c* on the end face 26*e* of the orbiting base plate 26*a*. The groove portions 26*d* are arranged at predetermined intervals in the circumferential direction of the rotary shaft 15. In FIG. 1, only one groove portion 26*d* is shown for illustrative purposes. An annular ring member 28 is fitted in each groove portion 26*d*. A pin 29 is inserted in each ring member 28. Each pin 29 protrudes from an end face 13*e* of the shaft support housing member 13 facing the orbiting scroll 26.

The scroll compressor 10 includes an elastic plate 30. The elastic plate 30 has an annular shape. The elastic plate 30 is sandwiched between the end face 13*e* of the shaft support housing member 13 and the opening end face of the outer peripheral wall 25*c*. The elastic plate 30 constantly urges the orbiting scroll 26 toward the fixed scroll 25.

The scroll compressor 10 includes an eccentric shaft 31. The eccentric shaft 31 protrudes toward the orbiting scroll 26 from a position eccentric to an axis L1 of the rotary shaft 15 on the end face 15*e* of the rotary shaft 15. The eccentric shaft 31 is integrally formed with the rotary shaft 15. The axial direction of the eccentric shaft 31 agrees with the axial direction of the rotary shaft 15. The eccentric shaft 31 is inserted in the boss portion 26*c*.

The scroll compressor 10 includes a balance weight 32 and a bushing 33. The bushing 33 is fitted to the outer peripheral surface of the eccentric shaft 31. The balance weight 32 is integrated with the bushing 33. The balance weight 32 is integrally formed with the bushing 33. The balance weight 32 is accommodated in the peripheral wall 18 of the shaft support housing member 13. The orbiting scroll 26 is supported by the eccentric shaft 31 with the bushing 33 and the rolling-element bearing 34 to be rotatable with respect to the eccentric shaft 31.

Rotation of the rotary shaft 15 is transmitted to the orbiting scroll 26 via the eccentric shaft 31, the bushing 33, and the rolling-element bearing 34. Thereby, the orbiting scroll 26 rotates. Then, the pins 29 come into contact with the inner peripheral surfaces of the respective ring members 28, whereby the rotation of the orbiting scroll 26 is prevented, and only the orbiting motion of the orbiting scroll 26 is allowed. As a result, the orbiting scroll 26 makes an orbiting motion while the orbiting volute wall 26*b* is in contact with the fixed volute wall 25*b*. As the volume of each compression chamber 27 decreases with the orbiting motion of the orbiting scroll 26, the refrigerant is compressed in the compression chamber 27. The orbiting scroll 26 orbits inside the outer peripheral wall 25*c* as the rotary shaft 15 rotates. The balance weight 32 cancels a centrifugal force acting on the orbiting scroll 26 when the orbiting scroll 26 makes an orbiting motion. This reduces the imbalance amount of the orbiting scroll 26.

As illustrated in FIGS. 1 and 2, the discharge housing member 14 includes a plate-shaped end wall 14*a* and a cylindrical peripheral wall 14*b*. The peripheral wall 14*b* extends in a tubular shape from the outer periphery of the end wall 14*a*. The axial direction of the peripheral wall 14*b* agrees with the axial direction of the rotary shaft 15. The peripheral wall 14*b* surrounds the fixed scroll 25. Accordingly, the fixed scroll 25 is accommodated in the housing 11.

The discharge housing member 14 includes bolt insertion holes 14*c*. The bolt insertion holes 14*c* open in the peripheral wall 14*b*. In FIG. 1, only one bolt insertion hole 14*c* is shown for illustrative purposes. Each bolt insertion hole 14*c* is connected to the corresponding bolt insertion hole 19*a* in the flange wall 19.

Bolts B1 passing through the respective bolt insertion holes 14*c* pass through the respective bolt insertion holes 19*a* in the flange wall 19 and are screwed in the respective internal thread holes 12*c* in the motor housing member 12. Thereby, the shaft support housing member 13 is coupled to the peripheral wall 12*b* of the motor housing member 12, and the discharge housing member 14 is coupled to the flange wall 19 of the shaft support housing member 13. Hence the motor housing member 12, the shaft support housing member 13, and the discharge housing member 14 are disposed in that order in the axial direction of the rotary shaft 15. The fixed scroll 25 is sandwiched between the end wall 14*a* of the discharge housing member 14 and the shaft support housing member 13. In this manner, the fixed scroll 25 is fixed to the housing 11. The discharge housing member 14 is coupled to the fixed scroll 25.

As illustrated in FIG. 2, the discharge housing member 14 includes a second discharge chamber forming recess 42 and a second oil reservoir chamber forming recess 52. The second discharge chamber forming recess 42 and the second oil reservoir chamber forming recess 52 open in the inner end face 14*e* of the end wall 14*a*. The second discharge chamber forming recess 42 has substantially the same shape as the first discharge chamber forming recess 41. The second oil reservoir chamber forming recess 52 has substantially the same shape as the first oil reservoir chamber forming recess 51.

The inner end face 14*e* of the end wall 14*a* includes a second annular end face 141 and a second connection end face 142. The second annular end face 141 has an annular shape extending along the outer periphery of the inner end face 14*e* of the end wall 14*a*. The second connection end face 142 has a shape of an elongated strip. The second connection end face 142 is connected to the second annular end face 141 and extends between the second discharge chamber forming recess 42 and the second oil reservoir chamber forming recess 52.

As illustrated in FIGS. 2 and 3, the second annular end face 141 extends along the first annular end face 251. The second annular end face 141 is a mating surface with the first annular end face 251. Hence the second annular end face 141 is an annular end face disposed to abut the fixed base plate 25*a*. The second connection end face 142 extends along the first connection end face 252. The second connection end face 142 is a mating surface with the first connection end face 252.

<Outer Peripheral Space S1>

As illustrated in FIG. 1, an outer peripheral space S1 is defined between the outer peripheral surface of the outer peripheral wall 25*c* and the inner peripheral surface of the peripheral wall 14*b*. Thus, the outer peripheral space S1 is defined between the outer peripheral surface of the fixed scroll 25 and the inner peripheral surface of the housing 11. The outer peripheral space S1 annularly extends around the fixed scroll 25. The outer peripheral space S1 is an annular gap existing between the outer peripheral surface of the outer peripheral wall 25*c* and the inner peripheral surface of the peripheral wall 14*b*.

The scroll compressor 10 includes a suction passage 35. The suction passage 35 includes first grooves 36, first holes 37, and second grooves 38. The first groove 36 is disposed in the inner peripheral surface of the peripheral wall 12*b*. The first groove 36 opens at an opening end of the peripheral wall 12*b*. The first hole 37 is disposed at the outer periphery of the flange wall 19 of the shaft support housing member 13. The first hole 37 extends through the flange wall 19 in the thickness direction. Each first hole 37 is connected to the corresponding first groove 36. The second groove 38 is provided in the inner peripheral surface of the peripheral wall 14*b* of the discharge housing member 14. Each second groove 38 is connected to the corresponding first hole 37. Each second groove 38 defines a part of the outer peripheral space S1.

A suction port 39 opens in the outer peripheral wall 25*c* of the fixed scroll 25. The suction port 39 extends through the outer peripheral wall 25*c* in the thickness direction. The suction port 39 is connected to the outer peripheral space S1. The suction port 39 is connected to the outermost peripheral portion of the compression chamber 27. Thus, the outer peripheral space S1 is connected to the compression chamber 27 via the suction port 39.

The refrigerant in the motor chamber 20 passes through the first groove 36, the first hole 37, the second groove 38, and the suction port 39 and is drawn into the compression chambers 27. Hence the refrigerant is drawn into the compression chambers 27 through the suction port 39. The first groove 36, the first hole 37, the second groove 38, and the suction port 39 are suction pressure zones through which the refrigerant drawn into the compression chambers 27 flows. Therefore, the outer peripheral space S1 is a suction pressure zone. The refrigerant drawn into the compression chambers 27 is compressed in the compression chamber 27 by the orbiting motion of the orbiting scroll 26. In this manner, the compression mechanism Cl compresses the refrigerant drawn into the housing 11.

<Gasket 70>

As illustrated in FIGS. 2 and 3, the scroll compressor 10 includes a plate-shaped gasket 70. The gasket 70 is a thin plate made of metal. The gasket 70 has an annular shape. The gasket 70 provides a seal between the end wall 14*a* of the discharge housing member 14 and the fixed base plate 25*a*.

The gasket 70 includes a discharge chamber connection hole 70*a* and an oil reservoir chamber connection hole 70*b*. The discharge chamber connection hole 70*a* has substantially the same shape as the first discharge chamber forming recess 41 and the second discharge chamber forming recess 42. The oil reservoir chamber connection hole 70*b* has substantially the same shape as the first oil reservoir chamber forming recess 51 and the second oil reservoir chamber forming recess 52.

The gasket 70 includes a first seal portion 71 and a second seal portion 72. The first seal portion 71 has an annular shape. The first seal portion 71 extends along the first annular end face 251 and the second annular end face 141. The first seal portion 71 is interposed between the first annular end face 251 and the second annular end face 141. The first seal portion 71 provides a seal between the first annular end face 251 and the second annular end face 141. Therefore, the gasket 70 provides a seal between the second annular end face 141 and the fixed base plate 25*a*.

The opposite ends of the second seal portion 72 are connected to two different places in the circumferential direction of the first seal portion 71. The second seal portion 72 has a shape of an elongated strip. The second seal portion 72 extends along the first connection end face 252 and the second connection end face 142. The second seal portion 72 is interposed between the first connection end face 252 and the second connection end face 142. The second seal portion 72 provides a seal between the first connection end face 252 and the second connection end face 142. The second seal portion 72 separates the discharge chamber connection hole 70*a* and the oil reservoir chamber connection hole 70*b* from each other. The second seal portion 72 includes a through hole 73.

As illustrated in FIGS. 2 and 3, the first discharge chamber forming recess 41 and the second discharge chamber forming recess 42 are connected to each other via the discharge chamber connection hole 70*a*. The first discharge chamber forming recess 41 and the second discharge chamber forming recess 42 define a discharge chamber 40. Accordingly, the scroll compressor 10 includes the discharge chamber 40. The refrigerant compressed in the compression chamber 27 is discharged into the discharge chamber 40.

The first oil reservoir chamber forming recess 51 and the second oil reservoir chamber forming recess 52 are connected to each other via the oil reservoir chamber connection hole 70*b*. An oil reservoir chamber 50 is defined by the first oil reservoir chamber forming recess 51 and the second oil reservoir chamber forming recess 52. Accordingly, the scroll compressor 10 includes the oil reservoir chamber 50. The oil separated from the refrigerant discharged into the discharge chamber 40 is stored in the oil reservoir chamber 50. The discharge chamber 40 and the oil reservoir chamber 50 are defined by the fixed scroll 25 and the discharge housing member 14. The discharge housing member 14 defines the discharge chamber 40 and the oil reservoir chamber 50 together with the fixed base plate 25*a*. The discharge chamber 40 and the oil reservoir chamber 50 are defined by the discharge housing member 14 and the fixed base plate 25*a* inside the second annular end face 141.

The second seal portion 72 of the gasket 70 provides a seal between the discharge chamber 40 and the oil reservoir chamber 50. Thus, the gasket 70 provides a seal between the discharge chamber 40 and the oil reservoir chamber 50. The scroll compressor 10 according to the present embodiment is mounted on a vehicle such that the oil reservoir chamber 50 is positioned below the discharge chamber 40.

As illustrated in FIG. 1, the scroll compressor 10 includes an oil separation chamber 60. The oil separation chamber 60 is disposed inside the discharge housing member 14. The oil separation chamber 60 is defined in an elongated cylindrical outer cylinder 61 that is a part of the end wall 14*a*. The first end of the outer cylinder 61 is a discharge outlet 62 for discharging the refrigerant to the outside. The discharge outlet 62 is connected to the oil separation chamber 60.

An inner cylinder 63 is fitted into the oil separation chamber 60. The axial direction of the inner cylinder 63 agrees with the radial direction of the rotary shaft 15. The first end of the inner cylinder 63 is connected to the discharge outlet 62. The second end of the inner cylinder 63 is connected to the side opposite to the discharge outlet 62 in the oil separation chamber 60. As illustrated in FIGS. 1 and 2, the outer cylinder 61 is provided with an introduction hole 64. The introduction hole 64 connects the discharge chamber 40 and the oil separation chamber 60 to each other. The introduction hole 64 introduces the refrigerant discharged into the discharge chamber 40 into the oil separation chamber 60.

The discharge housing member 14 includes an oil discharge hole 65. The first end of the oil discharge hole 65 is connected to the side opposite to the discharge outlet 62 in the oil separation chamber 60. As illustrated in FIG. 2, the second end of the oil discharge hole 65 opens in the second connection end face 142 of the discharge housing member 14. The oil discharge hole 65 is connected to the through hole 73 of the gasket 70. The oil separation chamber 60 is connected to the first oil reservoir chamber forming recess 51 via the oil discharge hole 65 and the through hole 73. Therefore, the oil separation chamber 60 is connected to the oil reservoir chamber 50 via the oil discharge hole 65 and the through hole 73.

As illustrated in FIG. 1, the refrigerant is compressed in the compression chambers 27, discharged into the discharge chamber 40 via the discharge port 25*h*, and introduced into the oil separation chamber 60 via the introduction hole 64. The refrigerant introduced into the oil separation chamber 60 swirls around the inner cylinder 63. As a result, a centrifugal force is applied to the oil contained in the refrigerant, and the oil is separated from the refrigerant in the oil separation chamber 60. Accordingly, the oil contained in the refrigerant discharged into the discharge chamber 40 is separated from the refrigerant in the oil separation chamber 60.

The refrigerant from which the oil has been separated flows into the inner cylinder 63 and passes through the inner cylinder 63. The refrigerant having passed through the inner cylinder 63 flows out to an external refrigerant circuit (not shown) via the discharge outlet 62. The oil separated from the refrigerant in the oil separation chamber 60 flows toward the oil discharge hole 65 by its own weight. Then, the oil flowing toward the oil discharge hole 65 is discharged into the oil reservoir chamber 50 via the oil discharge hole 65 and the through hole 73, and is stored in the oil reservoir chamber 50.

<Oil Passage 80>

As illustrated in FIG. 3, the scroll compressor 10 includes an oil passage 80. The oil separated from the refrigerant discharged into the discharge chamber 40 is guided to the outer peripheral space S1 through the oil passage 80. The oil passage 80 includes a restriction groove 81 and a connection passage 82. The restriction groove 81 is provided in the gasket 70. The restriction groove 81 extends along the first seal portion 71 of the gasket 70. The restriction groove 81 extends through the gasket 70 in the thickness direction. The restriction groove 81 is a slit provided in the gasket 70. The first end of the restriction groove 81 is connected to a space below the oil reservoir chamber 50. Thus, the restriction groove 81 is connected to the oil reservoir chamber 50. The second end of the restriction groove 81 is separated from the first end of the restriction groove 81 by approximately 180 degrees in the circumferential direction of the gasket 70. The restriction groove 81 is closed by the first annular end face 251 and the second annular end face 141. Therefore, the restriction groove 81 is closed by the discharge housing member 14 and the fixed scroll 25.

Figure 4:
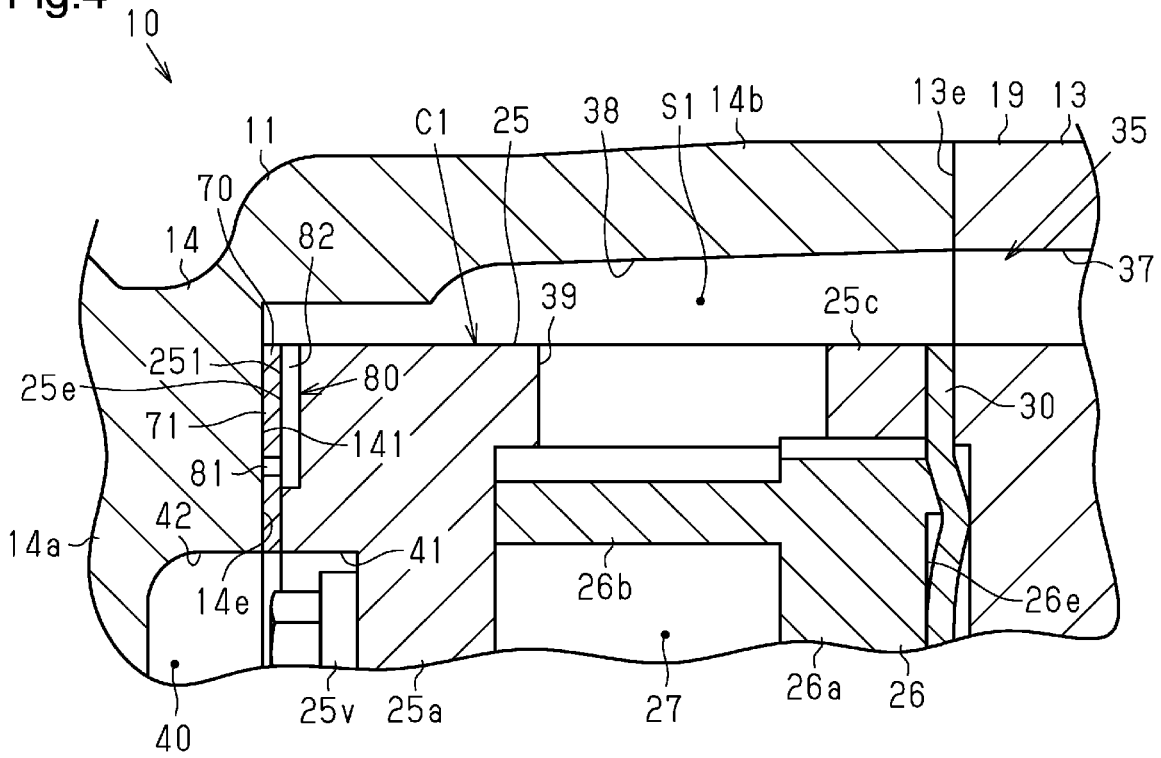
FIG. 4 is an enlarged cross-sectional view illustrating a part of the scroll compressor in FIG. 1.

As illustrated in FIGS. 3 and 4, the connection passage 82 is provided in the fixed base plate 25*a*. The connection passage 82 is a groove provided in the first annular end face 251. The first end of the connection passage 82 is connected to the second end of the restriction groove 81. The second end of the connection passage 82 opens at the outer peripheral edge of the fixed base plate 25*a*. As illustrated in FIG. 4, the second end of the connection passage 82 is connected to the outer peripheral space S1. Hence the connection passage 82 connects the restriction groove 81 and the outer peripheral space S1. As described above, the oil passage 80 is provided between the second annular end face 141 and the fixed base plate 25*a* and connects the oil reservoir chamber 50 and the outer peripheral space S1. Thus, the oil passage 80 is connected to the outer peripheral space S1.

The position of the opening of the connection passage 82 at the outer edge of the fixed base plate 25*a* is the same phase position in the circumferential direction of the rotary shaft 15 as that of the opening of the suction port 39 connected to the outer peripheral space S1. Therefore, the oil passage 80 is connected to the outer peripheral space S1 such that the opening of the oil passage 80 connected to the outer peripheral space S1 is at the same phase position in the circumferential direction of the rotary shaft 15 as the opening of the suction port 39 connected to the outer peripheral space S1.

Operation of Embodiment

Next, operation of the present embodiment will be described.

The oil stored in the oil reservoir chamber 50 is returned to the outer peripheral space S1 via the oil passage 80. At this time, with the oil passing through the restriction groove 81, the oil stored in the oil reservoir chamber 50 is returned to the outer peripheral space S1 in a decompressed state via the oil passage 80. The oil returned to the outer peripheral space S1 returns from the inside of the motor chamber 20 to the compression chamber 27 via the suction port 39 together with the refrigerant passing through the first groove 36, the first hole 37, and the second groove 38. The oil returned to the compression chamber 27 contributes to lubrication between the fixed scroll 25 and the orbiting scroll 26.

Advantages of Embodiment

The above embodiment has the following advantages.

(1) The outer peripheral space S1, which is connected to the compression chamber 27, is defined between the outer peripheral surface of the fixed scroll 25 and the inner peripheral surface of the housing 11. The scroll compressor 10 is provided with the oil passage 80 for guiding the oil separated from the refrigerant discharged into the discharge chamber 40 to the outer peripheral space S1. Therefore, the oil passage 80 only needs to be connected to the outer peripheral space S1, so that the placement position of the oil passage 80 can be freely set with respect to the outer peripheral space S1. Therefore, a limitation on the layout of the oil passage 80 such that the oil passage 80 must extend through the thick portion of the fixed scroll 25 as in the conventional technique is eliminated, thereby improving the degree of freedom in the design of the oil passage 80. As a result, the oil can be smoothly returned to the compression chamber 27, thus enabling sufficient lubrication between the fixed scroll 25 and the orbiting scroll 26. As described above, the reliability of the scroll compressor 10 can be improved.

(2) The oil passage 80 is provided between the second annular end face 141 and the fixed base plate 25*a* and connects the oil reservoir chamber 50 and the outer peripheral space S1. The space between the second annular end face 141 and the fixed base plate 25*a* is a suitable location for an oil passage 80, which connects the oil reservoir chamber 50 and the outer peripheral space S1, to be provided.

(3) The oil passage 80 includes the restriction groove 81 provided in the gasket 70, and the restriction groove 81 is connected to the oil reservoir chamber 50. Thus, the pressure in the outer peripheral space S1 is lower than the pressure in the oil reservoir chamber 50, so that the oil flowing out from the oil reservoir chamber 50 to the outer peripheral space S1 via the oil passage 80 is readily stored in the outer peripheral space S1. Therefore, for example, in the scroll compressor 10, the oil is readily stored in the outer peripheral space S1 even under operating conditions in which the oil stored in the oil reservoir chamber 50 to the outer peripheral space S1 via the oil passage 80 is reduced. As a result, a reduction in the amount of oil returned to the compression chamber 27 is avoided, thus enabling sufficient lubrication between the fixed scroll 25 and the orbiting scroll 26.

(4) For example, when the connection passage connecting the restriction groove 81 and the outer peripheral space S1 is provided in the gasket 70, a notch opening at the outer peripheral edge of the gasket 70 is provided in a part of the gasket 70. This makes the shape of the gasket 70 unstable, leading to difficulty in assembly. Therefore, the connection passage 82 connecting the restriction groove 81 and the outer peripheral space S1 is formed in the fixed base plate 25*a*. Thus, the shape of the gasket 70 is stabilized because there is no need to form a notch opening at the outer peripheral edge of the gasket 70 in a part of the gasket 70. It is thus possible to improve the reliability of the scroll compressor 10 while maintaining reliability of assembly.

(5) The oil passage 80 is connected to the outer peripheral space S1 such that the opening of the oil passage 80 connected to the outer peripheral space S1 is at the same phase position in the circumferential direction of the rotary shaft 15 as the opening of the suction port 39 connected to the outer peripheral space S1. For example, there may be a case in which the phase position of the opening connected to the outer peripheral space S1 in the oil passage 80 is shifted in the circumferential direction of the rotary shaft 15 with respect to the opening connected to the outer peripheral space S1 in the suction port 39. Compared with this case, the oil flowing out from the oil passage 80 into the outer peripheral space S1 smoothly flows into the suction port 39. Therefore, the oil in the outer peripheral space S1 smoothly returns to the compression chamber 27 via the suction port 39, thus enabling sufficient lubrication between the fixed scroll 25 and the orbiting scroll 26.

[Modifications]

The above-described embodiment may be modified as follows. The above-described embodiment and the following modifications can be combined if the combined modifications remain technically consistent with each other.

Figure 5:
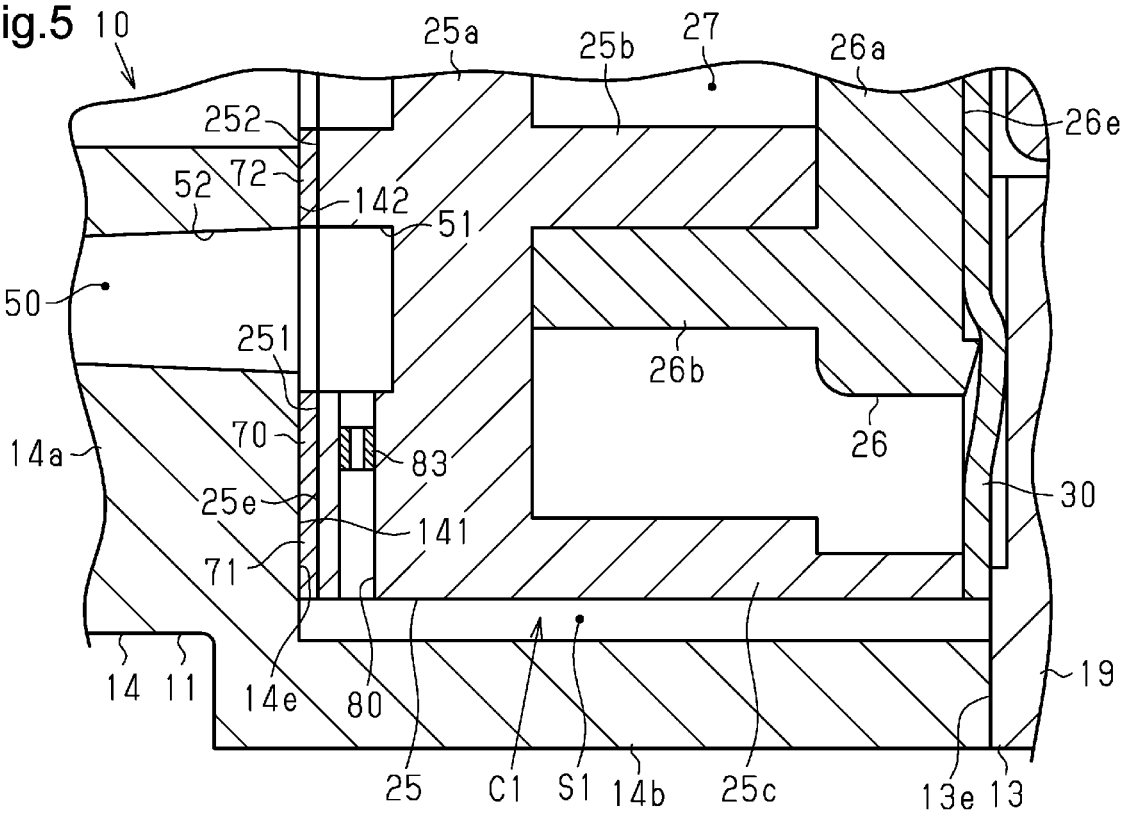
FIG. 5 is an enlarged cross-sectional view illustrating a part of a scroll compressor according to a first modification.

As in a first modification illustrated in FIG. 5, the gasket 70 does not necessarily need to include the restriction groove 81, and for example, the fixed scroll 25 may include the oil passage 80. The oil passage 80 extends through the inside of the fixed base plate 25*a* to connect the oil reservoir chamber 50 and the outer peripheral space S1 to each other. In this case, the oil passage 80 is provided with a restriction member 83. Therefore, it is only necessary to change the design of the fixed base plate 25*a* to form the oil passage 80. It is thus possible to improve the reliability of the scroll compressor 10 without complicating the configuration of the scroll compressor 10.

Figure 6:
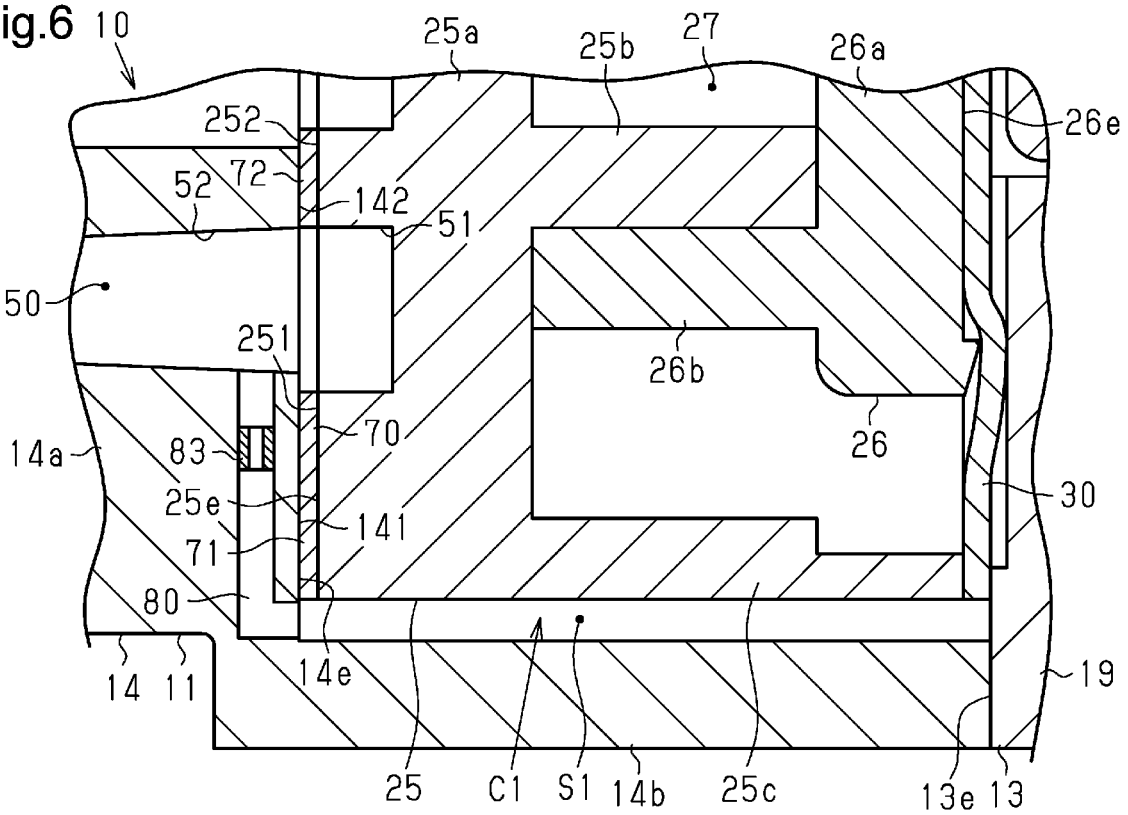
FIG. 6 is an enlarged cross-sectional view illustrating a part of a scroll compressor according to a second modification.

As in a second modification illustrated in FIG. 6, the gasket 70 does not necessarily need to include the restriction groove 81, and for example, the discharge housing member 14 may include the oil passage 80. The oil passage 80 extends through the inside of the discharge housing member 14 to connect the oil reservoir chamber 50 and the outer peripheral space S1. In this case, the oil passage 80 is provided with a restriction member 83. Therefore, it is only necessary to change the design of the discharge housing member 14 to form the oil passage 80. It is thus possible to improve the reliability of the scroll compressor 10 without complicating the configuration of the scroll compressor 10.

Figure 7:
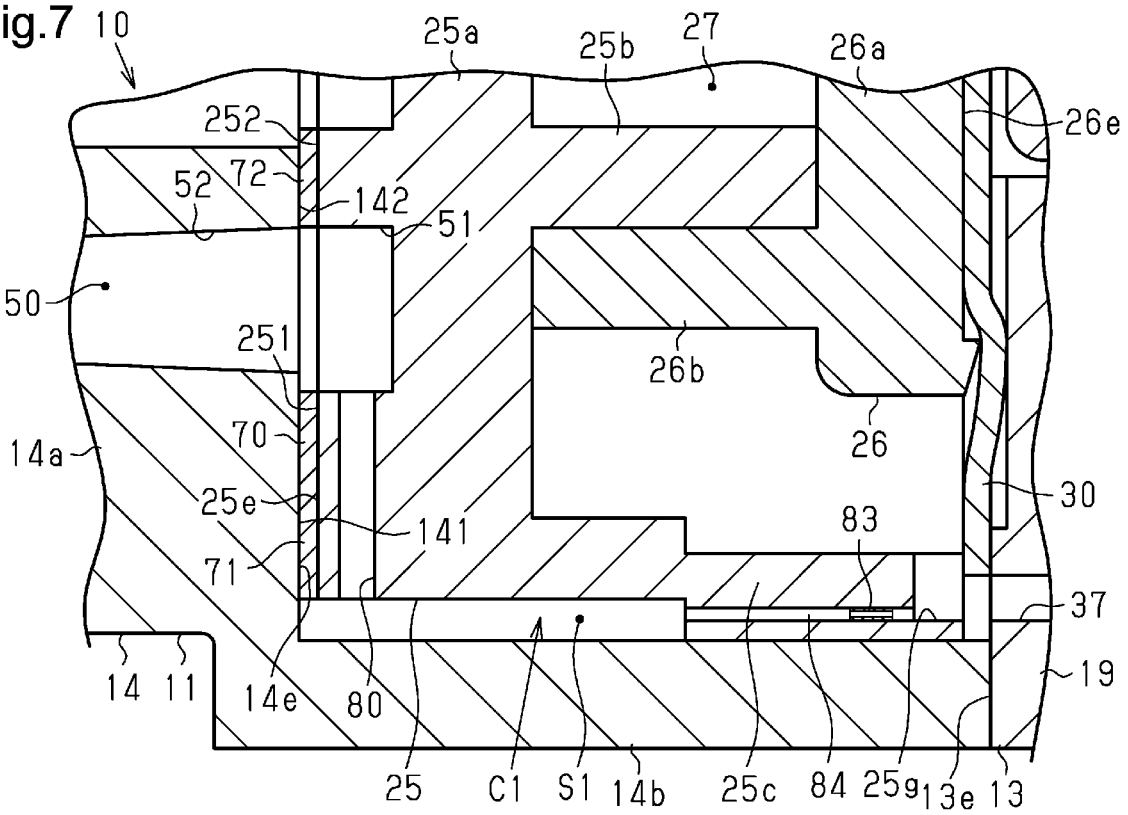
FIG. 7 is an enlarged cross-sectional view illustrating a part of a scroll compressor according to a third modification.

As in a third modification illustrated in FIG. 7, the gasket 70 does not include the restriction groove 81, and for example, a restriction may be provided in the oil flow path between the outer peripheral space S1 and the compression chamber 27 to set the outer peripheral space S1 as a discharge pressure zone. In the third modification, the suction port 39 does not open in the outer peripheral wall 25*c* of the fixed scroll 25. Passage recesses 25*g* open in the opening end face of the outer peripheral wall 25*c*. Each passage recess 25*g* opens to the opening end face of the outer peripheral wall 25*c*. Each passage recess 25*g* opens in the inner peripheral surface of the outer peripheral wall 25*c*. Each passage recess 25*g* is connected to the corresponding first hole 37, for example. Then, the refrigerant in the motor chamber 20 passes through the first groove 36, the first hole 37, and the passage recess 25*g*, and is drawn into the compression chamber 27.

For example, the fixed scroll 25 may include the oil passage 80. A connection path 84 may be provided in the outer peripheral wall 25*c* of the fixed scroll 25. The connection path 84 extends in the axial direction of the outer peripheral wall 25*c*. The first end of the connection path 84 is connected to the outer peripheral space S1. The second end of the connection path 84 opens in the bottom surface of one passage recess 25*g* of the passage recesses 25*g*. The connection path 84 is connected to the inside of one passage recess 25*g* of the passage recesses 25*g*. A restriction member 83 is provided in the connection path 84. In this manner, a restriction may be provided in the oil flow path between the outer peripheral space S1 and the compression chamber 27 to set the outer peripheral space S1 as a discharge pressure zone.

With this configuration, the pressure in the outer peripheral space S1 can be made equal to the pressure in the oil reservoir chamber 50, so that the oil stored in the oil reservoir chamber 50 smoothly flows to the outer peripheral space S1 via the oil passage 80. With the restriction member 83 being provided in the connection path 84, the oil returned to the outer peripheral space S1 is stably stored in the outer peripheral space S1.

The gasket 70 does not necessarily need to include the restriction groove 81, and for example, a restriction groove may be provided in the first annular end face 251 of the fixed scroll 25. For example, a restriction groove may be provided in the second annular end face 141 of the discharge housing member 14. In this case, the connection passage 82 is provided in the second annular end face 141. In this manner, the oil passage 80 may be provided between the second annular end face 141 and the fixed base plate 25*a* and connect the oil reservoir chamber 50 and the outer peripheral space S1.

A connection passage connecting the restriction groove 81 and the outer peripheral space S1 may be provided in the gasket 70.

The phase position of the opening connected to the outer peripheral space S1 in the oil passage 80 may be shifted in the circumferential direction of the rotary shaft 15 with respect to the opening connected to the outer peripheral space S1 in the suction port 39. With this configuration, for example, the oil returned from the oil passage 80 to the outer peripheral space S1 is readily stored once in the outer peripheral space S1 instead of directly flowing to the suction port 39. Therefore, it is possible to readily cause the outer peripheral space S1 to function as an oil reservoir space in which oil is stored.

The gasket 70 does not necessarily need to include the restriction groove 81, and for example, the elastic plate 30 may include the restriction groove. In this case, the oil stored in the oil reservoir chamber 50 passes through the hole extending through the fixed scroll 25 and the restriction groove provided in the elastic plate 30, and returns to the outer peripheral space S1.

The number of suction ports 39 is not particularly limited. For example, the number of oil passages 80 may be changed in accordance with the number of suction ports 39. For example, the oil passages 80 may be configured to be connected to the outer peripheral space S1 such that the openings of the respective oil passages 80 connected to the outer peripheral space S1 are at the same phase positions in the circumferential direction of the rotary shaft 15 as the openings of the respective suction ports 39 connected to the outer peripheral space S1.

The peripheral wall 12*b* of the motor housing member 12 may surround the fixed scroll 25. The outer peripheral space S1 may be defined between the outer peripheral surface of the outer peripheral wall 25*c* and the inner peripheral surface of the peripheral wall 12*b*. In short, the outer peripheral space S1 may be defined between the outer peripheral surface of the fixed scroll 25 and the inner peripheral surface of the housing 11.

The outer peripheral space S1 does not necessarily need to annularly extend around the fixed scroll 25. In short, the outer peripheral space S1 only needs to be a space defined between the outer peripheral surface of the fixed scroll 25 and the inner peripheral surface of the housing 11 and connected to the compression chamber 27.

The scroll compressor 10 does not necessarily need to be a type driven by the motor 22 and may be, for example, a type driven by an engine of a vehicle.

The scroll compressor 10 has been used in a vehicle air conditioner but is not limited thereto. In short, the scroll compressor 10 only needs to compress the refrigerant, and the application of the scroll compressor 10 can be changed as appropriate.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

REFERENCE SIGNS LIST

10 Scroll Compressor
11 Housing
14 Discharge Housing Member
15 Rotary Shaft
25 Fixed Scroll
25*a* Fixed Base Plate
25*b* Fixed Volute Wall
25*c* Outer Peripheral Wall
26 Orbiting Scroll
27 Compression Chamber
39 Suction Port
40 Discharge Chamber
50 Oil Reservoir Chamber
70 Gasket
80 Oil Passage
81 Restriction Groove
82 Connection Passage
141 Second Annular End Face as Annular End Face
S1 Outer Peripheral Space

What is claimed is:

1. A scroll compressor, comprising:
a housing;
a rotary shaft rotatably supported by the housing;
a fixed scroll accommodated in the housing and fixed to the housing;
an orbiting scroll that orbits as the rotary shaft rotates;
a compression chamber defined between the fixed scroll and the orbiting scroll;
a discharge chamber; and
an oil passage, wherein
a refrigerant drawn in from an outside is compressed in the compression chamber,
the refrigerant compressed in the compression chamber is discharged into the discharge chamber,
an outer peripheral space connected to the compression chamber is defined between an outer peripheral surface of the fixed scroll and an inner peripheral surface of the housing, and
oil separated from the refrigerant discharged into the discharge chamber is guided to the outer peripheral space through the oil passage,
further comprising an oil reservoir chamber in which oil separated from the refrigerant is stored, wherein
the fixed scroll includes a fixed base plate and a fixed volute wall extending from the fixed base plate,
the housing includes a discharge housing member that defines the discharge chamber and the oil reservoir chamber together with the fixed base plate,
the discharge housing member includes a plate-shaped end wall, a cylindrical peripheral wall, and an annular end face disposed to abut the fixed base plate, the peripheral wall extending in a tubular shape from the outer periphery of the end wall, and the peripheral wall surrounding the fixed scroll,
the discharge chamber and the oil reservoir chamber are defined by the discharge housing member and the fixed base plate inside the annular end face, and
the oil passage is provided between the annular end face and the fixed base plate and connects the oil reservoir chamber and the outer peripheral space to each other,
further comprising a gasket that provides a seal between the annular end face and the fixed base plate, wherein
the oil passage includes a restriction groove provided in the gasket,
the restriction groove is connected to the oil reservoir chamber,
the oil passage includes a connection passage that connects the restriction groove and the outer peripheral space to each other, and
the connection passage is provided in the fixed base plate, wherein the connection passage is a groove provided in the first annular end face, the first end of the connection passage is connected to the second end of the restriction groove, and the second end of the connection passage opens at the outer peripheral edge of the fixed base plate.

2. The scroll compressor according to claim 1, wherein an outer peripheral wall of the fixed scroll includes a suction port through which the refrigerant is drawn into the compression chamber, the outer peripheral space is connected to the compression chamber via the suction port, and the oil passage is connected to the outer peripheral space such that an opening of the oil passage connected to the outer peripheral space is at a same phase position in a circumferential direction of the rotary shaft as an opening of the suction port connected to the outer peripheral space.

3. A scroll compressor, comprising:

a housing;

a rotary shaft rotatably supported by the housing;

a fixed scroll accommodated in the housing and fixed to the housing;

an orbiting scroll that orbits as the rotary shaft rotates;

a compression chamber defined between the fixed scroll and the orbiting scroll;

a discharge chamber; and an oil passage, wherein a refrigerant drawn in from an outside is compressed in the compression chamber, the refrigerant compressed in the compression chamber is discharged into the discharge chamber, an outer peripheral space connected to the compression chamber is defined between an outer peripheral surface of the fixed scroll and an inner peripheral surface of the housing, and oil separated from the refrigerant discharged into the discharge chamber is guided to the outer peripheral space through the oil passage, further comprising an oil reservoir chamber in which oil separated from the refrigerant is stored, wherein the fixed scroll includes a fixed base plate and a fixed volute wall extending from the fixed base plate, the housing includes a discharge housing member that defines the discharge chamber and the oil reservoir chamber together with the fixed base plate, the discharge housing member includes an annular end face disposed to abut the fixed base plate, the discharge chamber and the oil reservoir chamber are defined by the discharge housing member and the fixed base plate inside the annular end face, and the oil passage is provided between the annular end face and the fixed base plate and connects the oil reservoir chamber and the outer peripheral space to each other, wherein an outer peripheral wall of the fixed scroll includes a suction port through which the refrigerant is drawn into the compression chamber, the outer peripheral space is connected to the compression chamber via the suction port, and the oil passage is connected to the outer peripheral space such that an opening of the oil passage connected to the outer peripheral space is at a same phase position in a circumferential direction of the rotary shaft as an opening of the suction port connected to the outer peripheral space.

* * * * *